US012533554B2

(12) United States Patent
Plaze et al.

(10) Patent No.: US 12,533,554 B2
(45) Date of Patent: Jan. 27, 2026

(54) CAMMING CLAMPING DEVICE AND METHOD FOR ADJUSTING A WIRE ELEMENT OF A CAMMING CLAMPING DEVICE

(71) Applicant: ZEDEL, Crolles (FR)

(72) Inventors: Pierre Plaze, Chignin (FR); Aurélie Bergez, Gieres (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 18/537,908

(22) Filed: Dec. 13, 2023

(65) Prior Publication Data

US 2024/0207683 A1 Jun. 27, 2024

(30) Foreign Application Priority Data

Dec. 22, 2022 (FR) ..... 2214247

(51) Int. Cl.
*A63B 29/02* (2006.01)

(52) U.S. Cl.
CPC ..... *A63B 29/024* (2013.01)

(58) Field of Classification Search
CPC ..... A63B 29/024; A63B 2225/09
See application file for complete search history.

(56) References Cited

U.S. PATENT DOCUMENTS 4,184,657 A 1/1980 Jardine
4,513,641 A * 4/1985 Murray ..... A63B 29/024 29/278
4,565,342 A 1/1986 Grow
4,575,032 A 3/1986 Taylor
4,645,149 A 2/1987 Lowe
4,832,289 A 5/1989 Waggoner
5,860,629 A 1/1999 Reed
6,679,466 B2 1/2004 Brown
6,736,359 B2 5/2004 Murray
7,278,618 B2 10/2007 Tusting et al.
(Continued)

FOREIGN PATENT DOCUMENTS

DE 28 24 654 A1 12/1978
DE 102015213205 A1 * 1/2017
(Continued)

OTHER PUBLICATIONS

Feb. 25, 2025 Non-Final Rejection received in U.S. Appl. No. 18/543,947.

(Continued)

*Primary Examiner* — Kimberly T Wood
(74) *Attorney, Agent, or Firm* — Oliff PLC

(57) ABSTRACT

A camming clamping device comprises a head with a cam installed swivelling around a pivot shaft between retracted and extended positions. An annular end is mechanically coupled to the head. A rod of variable length connects the head with an annular end designed to receive a carabiner. A wire element made from textile material passes through the rod to connect the head and the annular end. A trigger is installed slidingly to selectively engage the retracted position of the cam. An adjustment device of the length of the rod defines at least a distance between the head and the annular end that is greater than a threshold distance to stretch the wire element and compress the rod in the first direction.

9 Claims, 7 Drawing Sheets

(56) References Cited

U.S. PATENT DOCUMENTS

| | | | | |
|---|---|---|---|---|
| 9,302,154 | B2 | 4/2016 | Steck et al. | |
| 10,143,892 | B2 * | 12/2018 | Baker | A63B 29/024 |
| 10,463,916 | B2 | 11/2019 | Davidson | |
| 11,383,136 | B2 * | 7/2022 | Steck | A63B 29/024 |
| 2004/0035992 | A1 | 2/2004 | Watts | |
| 2006/0231708 | A1 | 10/2006 | Robertson et al. | |
| 2015/0001360 | A1 * | 1/2015 | Czech | A63B 29/024 248/231.9 |
| 2020/0034075 | A1 | 1/2020 | Li et al. | |
| 2021/0001181 | A1 | 1/2021 | Steck et al. | |

FOREIGN PATENT DOCUMENTS

| | | | | | |
|---|---|---|---|---|---|
| DE | 112020005469 | T5 * | 9/2022 | | A63B 29/024 |
| EP | 0 226 829 | A1 | 7/1987 | | |
| ES | 2639103 | T3 * | 10/2017 | | A63B 29/024 |
| GB | 2 158 540 | A | 11/1985 | | |
| GB | 2 369 068 | A | 5/2002 | | |
| GB | 2 380 949 | A | 4/2003 | | |
| GB | 2 461 807 | A | 1/2010 | | |
| WO | WO-2014152150 | A1 * | 9/2014 | | A63B 29/024 |

OTHER PUBLICATIONS

Nov. 20, 2024 Office Action issued in U.S. Appl. No. 18/538,412.
U.S. Appl. No. 18/543,947, filed Dec. 18, 2023 in the name of Plaze et al.
U.S. Appl. No. 18/538,412, filed Dec. 13, 2023 in the name of Plaze et al.

* cited by examiner

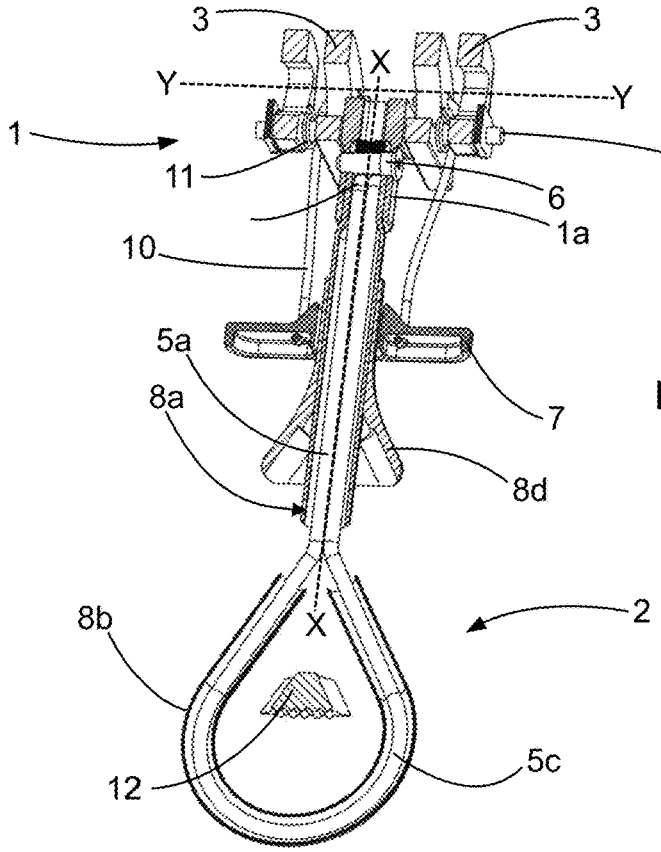
FIG. 11
FIG. 12
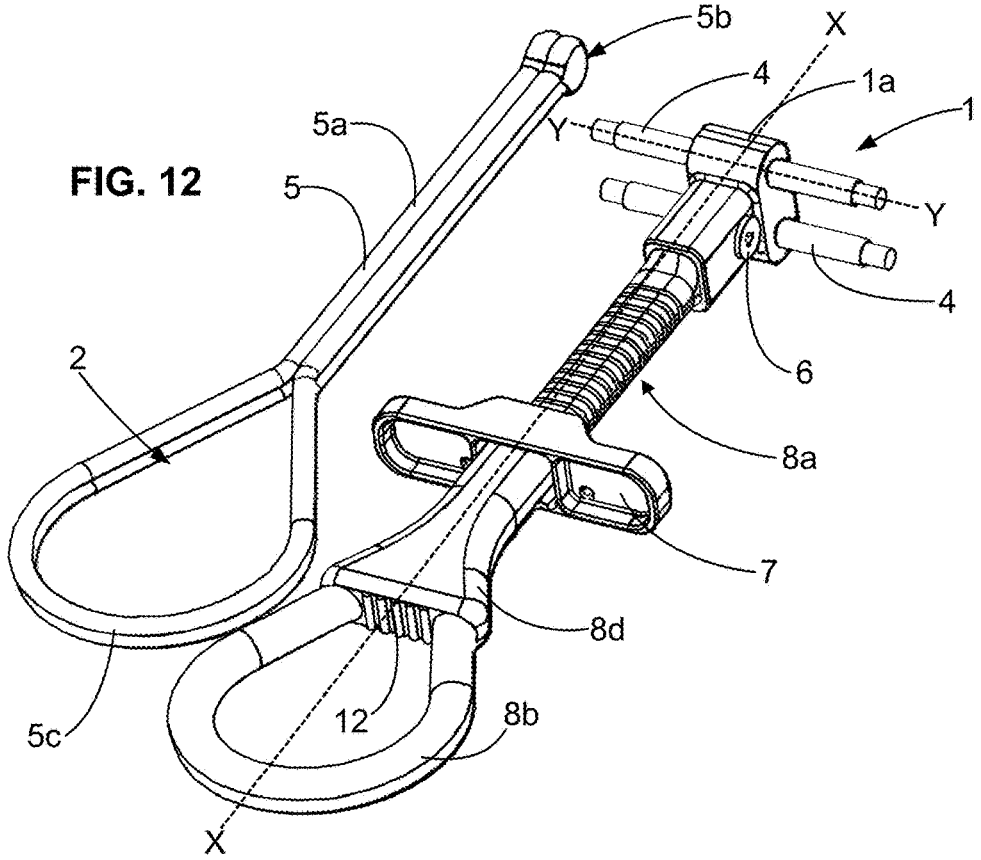

CAMMING CLAMPING DEVICE AND METHOD FOR ADJUSTING A WIRE ELEMENT OF A CAMMING CLAMPING DEVICE

BACKGROUND OF THE INVENTION

The invention relates to a camming clamping device, and to a method for adjusting a wire element of a camming clamping device.

PRIOR ART

During the climbing phases, a climber is required to place protection points on a rockface. The climber successively installs several protection points that are designed to support him in case of a fall. Certain rockfaces are equipped with pre-installed protection points, for example in the form of spits that are sealed in the rock. Other rockfaces are not equipped with such points so that the climber has to find the crevice that is most suitable for installing his protection point.

When the climber has to place his/her protection points, it is conventional to install passive chocks and active chocks. The chocks are designed to be inserted in crevices that are generally holes, cracks, channels or any other recess that is deep enough to enable a chock to be inserted. Each particular shape of crevice is suitable for a particular chock configuration. Passive chocks are often formed by metal parts having a specific shape. In a first spatial position, the chock can be inserted in a fault of a rockface and, in a second spatial position, the chock is wedged between two opposite faces. It is then possible to install and remove the chock easily, provided that the latter is placed in the right spatial configuration inside the hole. If this is not the case, in case of a fall, the spatial configuration of the chock will be such that it will be jammed between the two opposite faces of the hole.

In addition to passive chocks, active chocks are also known, also called camming chocks or friend cam. The camming chock is provided with a head that has a plurality of cams. The cams are mounted movable around one or more pivot shafts.

The cams move between a retracted position and an extended position. In the retracted position, the volume occupied by the head is less than in the extended position. The head of the chock is inserted in a crack in its retracted position, and the cams then seek to move to the extended position which presses the cams against the two opposite faces of a crack. The shape of the cams has the effect of increasing the force applied on the faces of the crack when a pull is exerted on the chock.

In conventional manner, a camming chock has a head, at a first end, provided with several rotary cams. The second end of the camming chock is an annular end that is configured to receive a carabiner and to act as anchor point for the climber.

The head is mechanically connected to the annular end by means of a cable that is generally a steel cable. The two ends of the cable are clamped in the head of the chock by crimping. The cable extends continuously between the two ends along the body and extends along the annular end so as to ensure the mechanical continuity between the end fixed to the rockface and the end designed to support the climber.

When the cable does not have the transverse rigidity necessary to ensure that placing of the chock is well mastered, it is conventional to provide a rod that extends from the head in the direction of the annular end. The cable passes through the rod.

Actuation of the cams is achieved by means of a trigger that is installed movable sliding along the rod. When the user pulls on the trigger in the direction of the annular end, the cams move to the retracted position. When the user interrupts this pulling action, a spring returns the cams to the extended position.

A large number of configurations of camming chocks are known describing different configurations of cams, cables, rods or annular ends.

In conventional manner, the cable passes through a hollow rod that extends from the head. The rod is passed through by the cable to ensure the mechanical continuity. However, an alternative architecture exists in which one or more rigid metal rods connect the head to the annular end. It is no longer necessary to use a cable. This alternative configuration is known from the following documents: DE2824654, U.S. Pat. Nos. 4,565,342, 4,575,032, 4,645,149, GB2158540, U.S. Pat. Nos. 4,184,657, 4,513,641, and GB2369068. This infinitely rigid rod configuration is not advantageous as it does not enable the chock to be installed easily in curved cracks.

In conventional manner, the metal cable that extends from one end of the camming chock to the other is U-shaped, the two top ends thereof being fixed to the head by crimping whereas the base portion which is generally the central portion defines the annular end. The documents US2021/0001181 and US2020/034075 illustrate a camming chock the two ends of the metal cable of which are crimped in the head under the pivot shafts of the cams. The documents US2020/034075 and U.S. Pat. No. 4,832,289 also disclose an embodiment in which only one end of the cable is crimped in the head of the chock. The other end is crimped to form the annular end. The documents U.S. Pat. Nos. 7,278,618 and 6,679,466 disclose a cable each end of which is crimped independently on each side of the cams. An end-piece defining a hole is crimped at each end and the hole of the end-piece receives a shaft which secures the cable with the head.

The documents U.S. Pat. No. 5,860,629 and GB2380949 disclose a cable one end of which is crimped in the head of the chock and the other end of which receives an end-piece forming the annular end. The end-piece is crimped on the cable.

The document U.S. Pat. No. 6,679,466 illustrates a camming chock in which the two ends of the metal cable each pass round an attachment shaft of the head. The two ends form a cable loop which is crimped to ensure the mechanical continuity along the camming chock.

For these configurations, the length of the chock is defined with the distance of cable which is crimped.

In order to provide a lighter product, it is proposed to replace the steel cable by a Dyneema® strap. The two ends of the strap are fixed in the head and the strap extends along the chock to define the annular end. A technical solution is delivered in the document U.S. Pat. No. 10,143,892 that proposes to form a loop in a Dyneema® strap by means of a splicing step. The loop is used to secure the end of the strap in the head of the clamping device.

The lifetime of such a strap is much shorter than the lifetime of the steel cable used previously and much shorter than the lifetime of the head. The splicing step is a long and costly step. It is also apparent that the size of the loop is much less well-mastered than with crimping steps which can generate differences of length in the chocks and therefore hamper the climber. This means that the length of the rod has to be adjusted.

To be able to ensure precise positioning of the cams in a crack, it is important for the camming clamping device to have a certain rigidity perpendicularly to the axis connecting the head and the annular end. This imposes a complex assembly of the different components with respect to one another. According to the teaching of the document U.S. Pat. No. 10,143,892, two springs are installed between the two portions of the rod before the loop is formed to stress the textile wire element. This makes formation of the loop by splicing more complicated.

OBJECT OF THE INVENTION

One object of the invention consists in providing a camming clamping device that presents a good rigidity perpendicularly to the direction connecting the head and the annular end while at the same time presenting a simpler design to possibly make subsequent repair operations easier to perform.

To address this problem, it is advantageous to provide a camming clamping device comprising:

- a head;
- at least one pivot shaft fixed to the head;
- at least one cam coupled to the head and installed movably swivelling around the at least one pivot shaft, the at least one cam being movable between a retracted position and an extended position;
- a spring coupled to the at least one cam to bias the at least one cam to the extended position;
- an annular end mechanically coupled to the head, the annular end being designed to receive a connecting part;
- a rod extending from the head to the annular end in a first direction, the rod having a first end fixed to the head and a second end totally or partially defining the annular end;
- at least one wire element continuously connecting the head and the annular end, the at least one wire element extending in the first direction and passing through the rod;
- an actuating system configured to selectively engage the retracted position of the at least one cam, the actuating system having a trigger installed slidingly along the first direction.

The camming clamping device is remarkable in that the rod is a rod of adjustable length to apply a tractive force to the wire element from the head to the annular end, the rod has at least a proximal part and a distal part, the distal part being arranged movable with respect to the proximal part to adjust the length of the rod, and

- in that at least one clamp is configured to block the rod at a required length by blocking the position of the distal part with respect to the proximal part.

According to one feature of the invention, the clamp only blocks the distal part with respect to the proximal part without jamming the wire element.

In advantageous manner, the wire element is a textile wire element.

In a particular configuration, the wire element is a textile wire element defining a stitched ring and the distal part comprises a tubular element, the wire element passing through the tubular element, the two ends of the ring being fixed to the head.

In an advantageous development, the wire element is attached to the head by an anchoring part, the anchoring part being arranged at a distance from the cams in a direction of observation parallel to the swivelling axis of the at least one pivot shaft, the anchoring part being arranged between the annular end and the at least one pivot shaft.

Preferentially, one of the proximal part or the distal part has a crenellated part and the other of the proximal part and the distal part has at least one tooth configured to insert in at least one slot of the slots of the crenellated part, the slots of the crenellated part being arranged consecutively along the first direction.

In one embodiment, the proximal part extends from the head to a portion of the annular part, the clamp partially defining the through hole of the annular end.

In an advantageous development, the proximal part partially defines the through hole of the annular end.

Preferentially, the rod is a telescopic rod.

In another advantageous development, the proximal part defines a plurality of adjustment stops, the distal part being jammed against one stop of the plurality of adjustment stops.

Preferentially, in the rest position, the trigger is facing said one stop of the plurality of adjustment stops.

It is a further object of the invention to provide a method for installing a wire element that is easier to adjust than in the prior art configurations.

This result tends to be achieved by means of a method for adjusting a wire element of a camming clamping device comprising the following steps:

- providing a camming clamping device according to any one of the foregoing configurations;
- lengthening the rod to apply a tractive force and stretch the wire element and apply a compressive stress on the rod;
- fixing the length of the rod stretching the wire element.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which:

FIG. 11 schematically illustrates an exploded sectional view of a third embodiment of a camming clamping device;

FIG. 12 schematically illustrates a perspective view of a fourth embodiment of a camming clamping device with the representation of the equivalent conformation of the wire element;

DESCRIPTION OF THE EMBODIMENT

Figure 1:
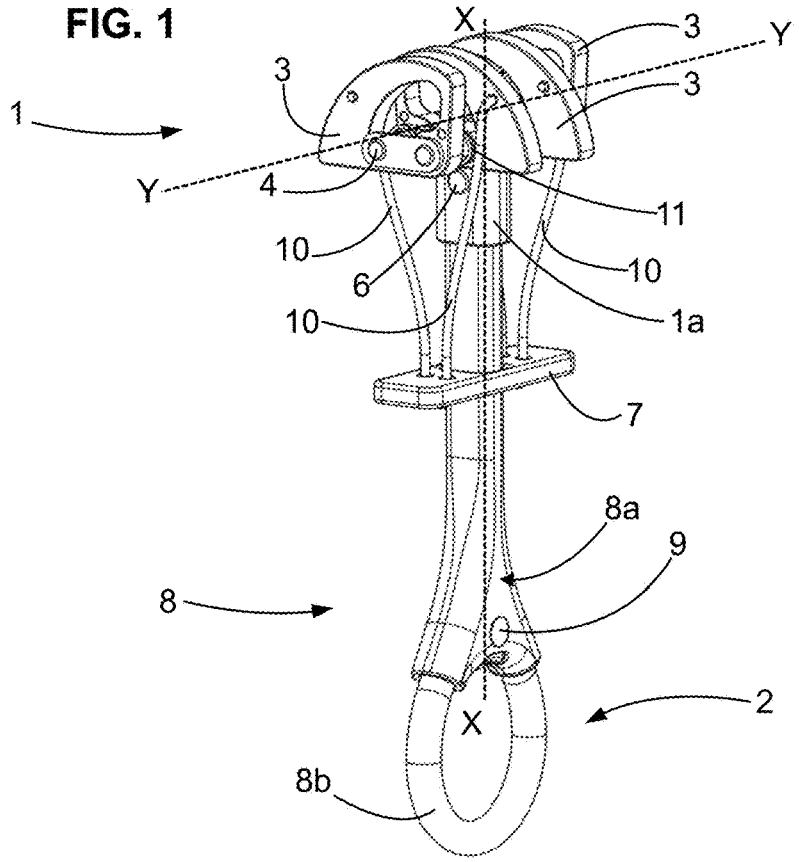
FIG. 1 schematically illustrates a perspective view of a first embodiment of a camming clamping device.
Figure 2:
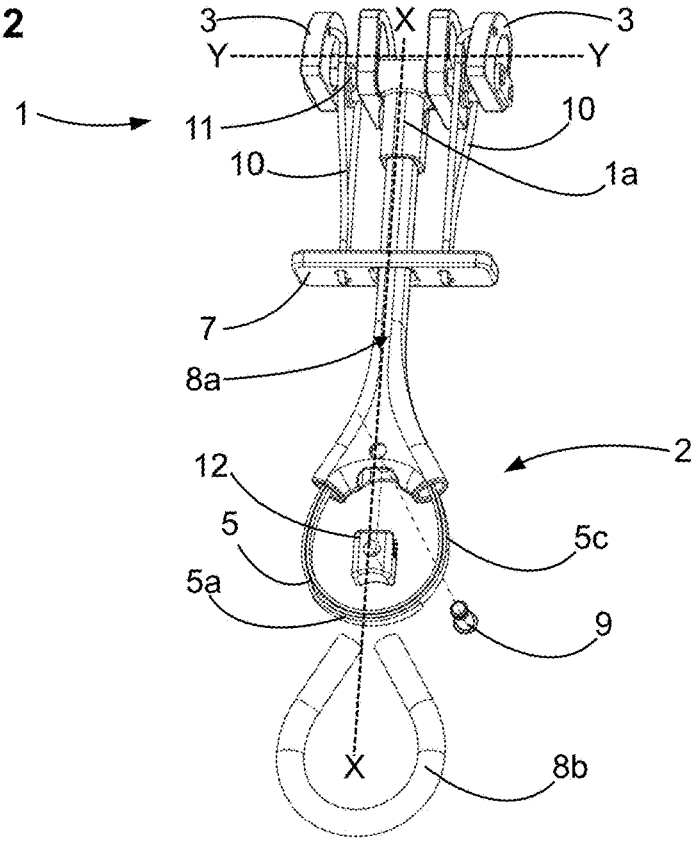
FIG. 2 schematically illustrates a perspective view of a first embodiment of a camming clamping device with an exploded view of the annular end.

FIGS. 1 to 13 illustrate different embodiments of a camming clamping device also referred to as "camming clamp". The camming clamping device is an active clamping device.

The camming clamping device comprises a first end that is a head 1 and an opposite second end that is an annular end 2. In conventional manner, the annular end 2 is in the form of a ring defining a through hole configured to receive a carabiner. The annular end 2 is able to support the weight of a user. The head 1 has at least one cam 3 and preferably several cams 3 that are installed movably swivelling between an extended position and a retracted position. Preferably, several cams 3 are installed movable independently from one another.

The cam or cams 3 are installed movable around at least one pivot shaft 4. The pivot shaft 4 is fixed to the head 1, more precisely the pivot shaft 4 is fixed to a body 1*a* of the head 1. The body 1*a* can be formed by one or more parts.

The camming clamping device has a wire element 5 mechanically connecting the head 1 to the annular end 2. The wire element 5 couples the cams 3 mechanically to the annular end 2 so that a user attached to the annular end 2 is securedly held by means of the cams 3 wedged for example in a crack. The wire element 5 is the component that ensures the mechanical continuity between the head 1 and the annular end 2. The cam or cams 3 are mechanically coupled to the annular end 2. The wire element 5 extends in a first direction XX connecting the head 1 to the annular end 2 so as to achieve the mechanical resistance in this first direction XX. The wire element 5 is attached to the head 1 and extends continuously from the head 1 until it reaches the annular end 2 to achieve the mechanical continuity along the clamping device.

The pivot shaft 4 extends mainly in a second direction YY that is perpendicular or substantially perpendicular to the first direction XX. The cam or cams 3 are installed rotatable around the second direction YY.

The head 1 preferably has at least one anchoring part 6, for example an anchoring part shaft. Advantageously, the wire element 5 is fixed to the anchoring part 6 so as to mechanically couple the wire element 5 and the head 1.

The wire element 5 preferably defines at least one loop through which the anchoring part 6 passes to perform the force take-up with the annular end 2 when the camming clamping device is subjected to a tensile force in the longitudinal first direction XX. In preferential manner, the wire element 5 is a textile material. Advantageously, the textile material is a polyethylene of very high molar mass, for example made from a material marketed under the tradenames Dyneema® or Spectra®.

In a particular embodiment illustrated in FIGS. 1 to 13, the wire element 5 is in the form of a ring. It is advantageous for the ring to be obtained by joining two terminations of the wire element 5 to one another. The two terminations can be fixed to one another by a stitched seam 5*d* as illustrated in FIGS. 2, 3, 4, 6, 7, 8, 9 for a textile wire element. The stitched seam is a well-mastered method that enables a ring of well-controlled mechanical strength to be easily obtained. The use of a stitching step enables a ring to be formed that is less expensive and with a dimension that is better mastered than its equivalent obtained by splicing. It is advantageous for the ring to be devoid of crimping and splicing. The wire element 5 can be a strap or a rope.

The clamping device comprises an actuating system coupled to the at least one cam 3. The actuating system is configured to selectively engage the retracted position of the at least one cam 3. The actuating system has a trigger 7 arranged slidingly along the first direction XX connecting the head 1 and the annular end 2.

The trigger 7 is installed movable with respect to the head 1 and is coupled to the at least one cam 3. The trigger 7 is coupled to the at least one cam 3 so that movement of the trigger 7 away from the head 1 results in movement of the at least one cam 3 to the retracted position, i.e. away from the extended position. In preferential manner, the trigger 7 is coupled to all the cams 3 so that movement of the trigger 7 away from the head 1 results in movement of the cams 3 to the retracted position. Outside the first trigger position, the at least one cam 3 is outside the extended position.

Preferentially, when the at least one cam 3 is in a retracted position, the at least one cam 3 does not prevent movement of the trigger 7 in the direction of the head 1.

In a preferential embodiment, the trigger 7 is installed able to slide along the wire element 5 between the head 1 and the annular end 2. The trigger 7 can be coupled to the cam 3 or to each cam 3 by an additional wire element 10. The additional wire element 10 can be a metal cable, a textile element or a wire element made from synthetic material, for example from plastic. The additional wire element 10 couples the cam 3 mechanically with the trigger 7 and enables a movement of the trigger 7 to the second trigger position to be relayed, i.e. a movement towards the annular end 2 to be transformed into a movement of the cam 3 to the retracted position. Movement of the at least one cam 3 from the retracted position to the extended position results in movement of the trigger 7 away from the second trigger position.

The camming clamping device has a spring 11 that is configured to bias the at least one cam 3 to the extended position. The spring 11 can be manufactured in any technology, it can be a coil spring operating in traction, in compression, in torsion or in flexion. It can also be a metal blade or wire that is elastically deformed. In the absence of any stress and obstacle, the spring 11 places the cam or cams 3 in the extended position. The force applied on the trigger 7 to move away from the head 1 corresponds to a force applied on the spring 11 to move the cam or cams 3 away from the extended position. In one embodiment, the spring 11 is fixed on the one hand to the cam 3 and on the other hand to the head 1. In another embodiment, the spring 11 is fixed on the one hand to a first cam 3 on the other hand to a second cam 3 installed on a different pivot shaft 4 from first cam 3. The clamping device can comprise as many springs 11 as the cams 3 and/or as many springs 11 as pairs of cams 3.

When the wire element 5 is a textile material, it is difficult to have a good rigidity perpendicularly to the first direction XX by means of the wire element 5, and the rigidity is then procured by an additional element such as the rod. The same is the case when the wire element 5 is a metal cable of small cross-section. To increase the rigidity perpendicularly to the first direction XX, the camming clamping device comprises at least one rod 8 that extends in the first direction XX from the head 1 up to the annular end 2. The at least one rod 8 is fixed on the one hand to the head 1 and it partially or totally defines the annular end 2. Preferably, a first end of the rod 8 can come up against the stop formed by the head 1. The force applied by the wire element presses one end of the head of the rod 8 against the head 1.

In the embodiments illustrated in FIGS. 1 to 13, the camming clamping device comprises a single rod 8 that extends longitudinally in the first direction XX.

The rod 8 is more rigid than the wire element 5 perpendicularly to the direction XX which enables the camming clamping device to be secured by means of the rod 8 and the clamping device to be placed precisely in a crack in comparison with an equivalent device without the rod 8. It is advantageous for the trigger 7 to be installed slidingly along the rod 8 and for the rod 8 to separate the wire element 5 and the trigger 7. To protect the wire element, it is advantageous for the wire element 5 to pass through the rod 8.

In order to ensure a good rigidity perpendicularly to the first direction XX, it is advantageous to apply a tensile stress on the wire element from its attachment point to the head up to the annular end 2. To apply a tensile stress on the wire element 5, the rod 8 is used which then receives a compressive force in the first direction XX applied by the wire element.

Manufacture of the wire element results in a disparity around a target length. The same is the case for manufacture of the rod. In order to apply a sufficient force on the wire element, it is preferable to adjust the lengths of the wire element and of the rod. It is therefore particularly advantageous to use a rod the length of which is adjustable in the first direction XX so as to apply a tensile stress on the wire element 5 in the first direction XX. Whereas the document U.S. Pat. No. 10,143,892 proposes using springs which will be stressed when the wire element is attached to the head, it is proposed to form a rod 8 in two parts with a clamp that freezes the length of the rod 8.

In a particular embodiment, the rod 8 has a variable length. The use of a variable length enables the length of the rod 8 to be adjusted to the effective length of the wire element 5 between the head 1 and the annular end 2. To obtain a rod 8 of variable length, it is advantageous to have a rod made in at least two parts, with a first part 8*a* fitted movable with respect to a second part 8*b* in the first direction XX. By moving the first part 8*a* with respect to the second part 8*b*, the length of the rod 8 can be adjusted. A tractive force can be applied on the wire element 5 in the first direction XX. This enables the rod 8 to be stressed in compression by means of the wire element 5 thereby enhancing the rigidity of the rod 8. The length is measured in the first direction XX.

Depending on the embodiments, adjustment of the length of the rod 8 can be continuous or by increments. Once the length has been defined, a clamp 12 enables the position of the second part 8*b* to be fixed with respect to the first part 8*a*. As the wire element 5 is more rigid than the rod 8 in the first direction XX, the wire element 5 will oppose the increase of the length of the rod 8 which will be stressed compressively. Compression of the rod 8 will make it possible to have a rod 8 that is more rigid perpendicularly to first direction YY thereby improving precise installation of the clamping device in the crack.

In a first clamp position, the length of the rod 8 can vary which avoids stressing the wire element 5 or an excessive stress being applied on the wire element. This makes securing of the wire element 5 with the head 1 easier to perform. In a second clamp position, the length of the rod 8 is freezed. The length of the rod 8 defines the degree of force applied on the wire element 5.

In other words, the camming clamping device comprises an adjustment device of the length of the rod 8 configured to separate the head 1 and the annular end 2 beyond at least a threshold distance and to apply a tractive force on the wire element 5 in the first direction XX.

The rod 8 has a proximal part 8*a* that comes up against the stop formed by the head 1 or is fixed to the head. The rod 8 also has a distal part 8*b* forming all or part of the annular end 2 and separated from the head 1 by the proximal part 8*a*. The distal part 8*b* is arranged movable with respect to the proximal part 8*a* to vary the length of the rod 8 and apply the tractive force on the wire element 5 in the first direction XX. This solution is simple to implement and enables the length of the rod 8 to be adjusted to the length of the wire element 5.

It is advantageous for proximal part 8 and the distal part 8*b* to comprise or be formed by a tube through which the wire element 5 passes. The distal part 8*b* protects the wire element 5 against wear in all or part of the annular end 2.

In advantageous manner, the proximal part 8*a* defines at least one cavity designed to receive one end of the distal part 8*b*. When the clamp 12 is in the first clamp position, the end of the distal part 8*b* is installed fixed in the cavity. When the clamp 12 is in the second clamp position, the end of the distal part 8*b* can slide in the cavity.

In preferential manner illustrated in FIGS. 1 to 13, the tubular part of the distal part 8*b* of the rod 8 is able to deform elastically perpendicularly to the first direction XX in order to better match its shape with the shape of the wire element 5 under a tensile force. In preferential manner, the wire element 5 is in continuous contact with the tubular part of the distal part 8*b* so that the strains applied in the annular end 2 are taken up by the wire element 5. When it deforms, the tubular part of the distal part 8*b* applies a tensile force on the wire element 5 and a compressive force on the proximal part 8*a*. Deformation of the distal part 8*b* increases the rigidity perpendicularly to the first direction XX.

Figure 7:
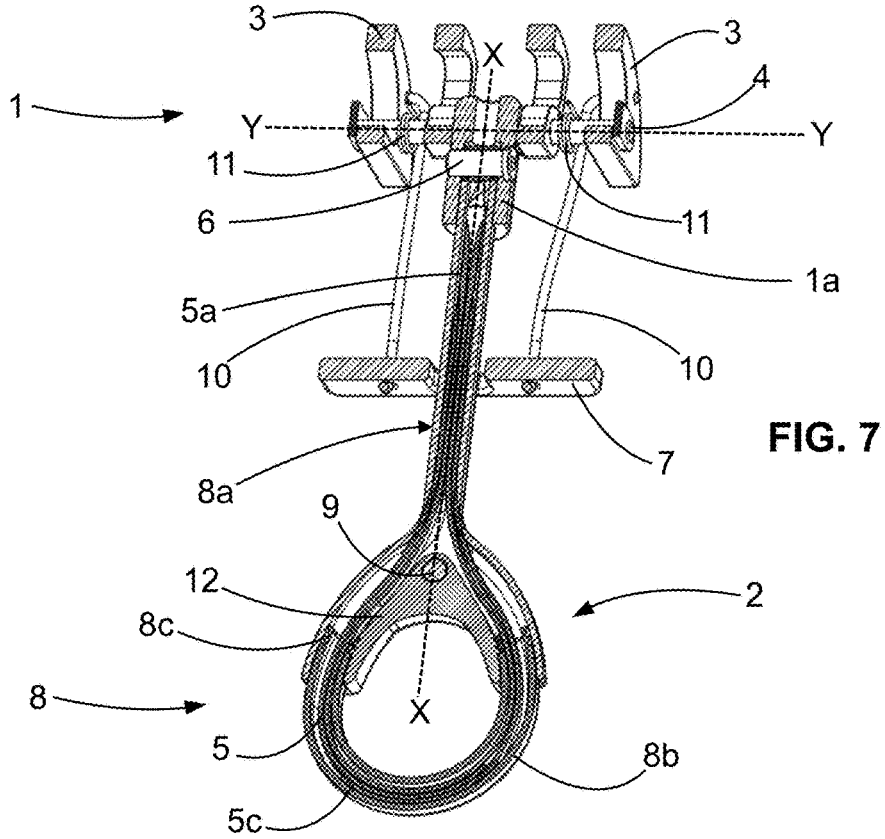
FIG. 7 schematically illustrates a sectional view of a second embodiment of a camming clamping device, in the non-stretched position.
Figure 8:
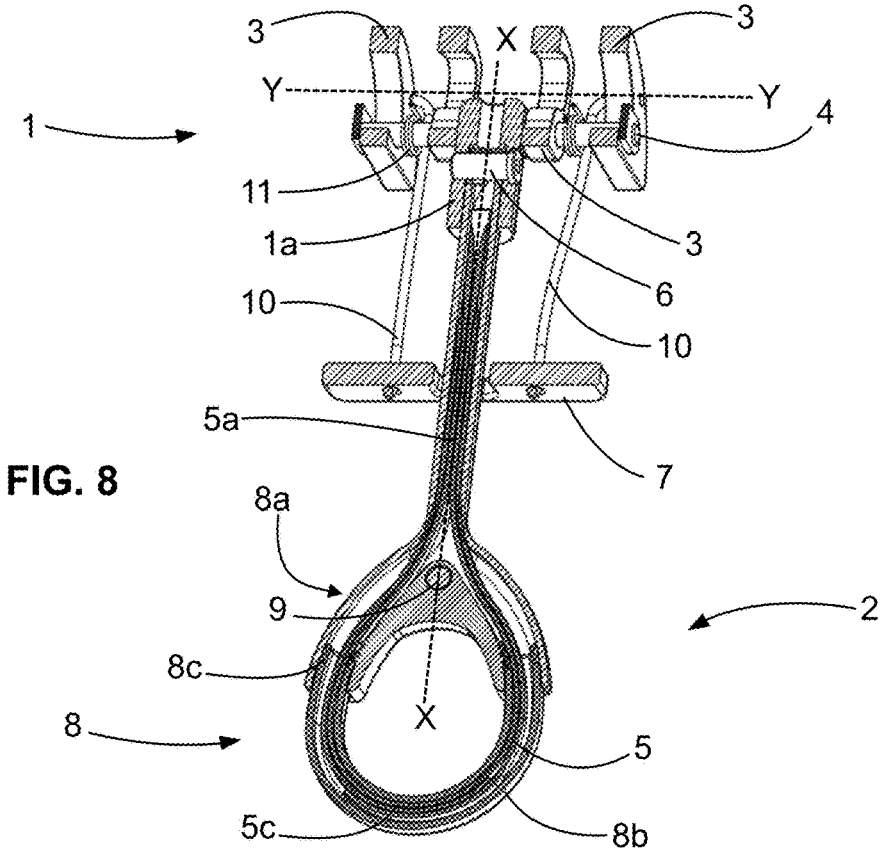
FIG. 8 schematically illustrates a sectional view of a second embodiment of a camming clamping device, in the stretched position.

Advantageously, one of the proximal part 8*a* and the distal part 8*b* has a crenellated part 8*c* and the other of the proximal part 8*a* and the distal part 8*b* has at least one tooth configured to be inserted in at least one slot of the slots of the crenellated part 8*c*. The slots are arranged consecutively along the first direction XX. The use of a plurality of slots operating in conjunction with at least one tooth and preferably with a plurality of teeth enables several distinct lengths of the rod 8 to be defined. It is then easier to adjust the length of the rod 8 to the length of the wire element 5 and to maintain this length. Such an embodiment is illustrated in FIGS. 7 and 8 and can be applied to the other embodiments.

In the embodiments illustrated in FIGS. 1 to 13, the camming clamping device comprises a clamp 12 that is configured to block the position of the distal part 8*b* with respect to the proximal part 8*a*. The clamp 12 is fitted removable with respect to the rod 8. The clamp 12 can comprise a screw 9 or any other securing means to secure the clamp 12 to the rod 8.

Figure 3:
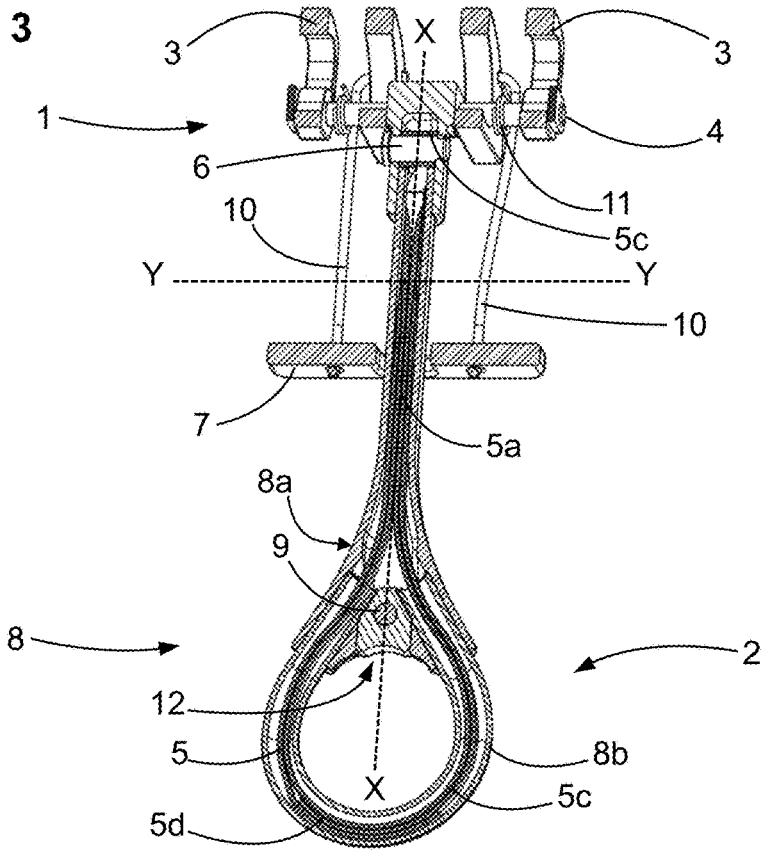
FIG. 3 schematically illustrates a sectional view of a first embodiment of a camming clamping device, in the non-stretched position.
Figure 4:
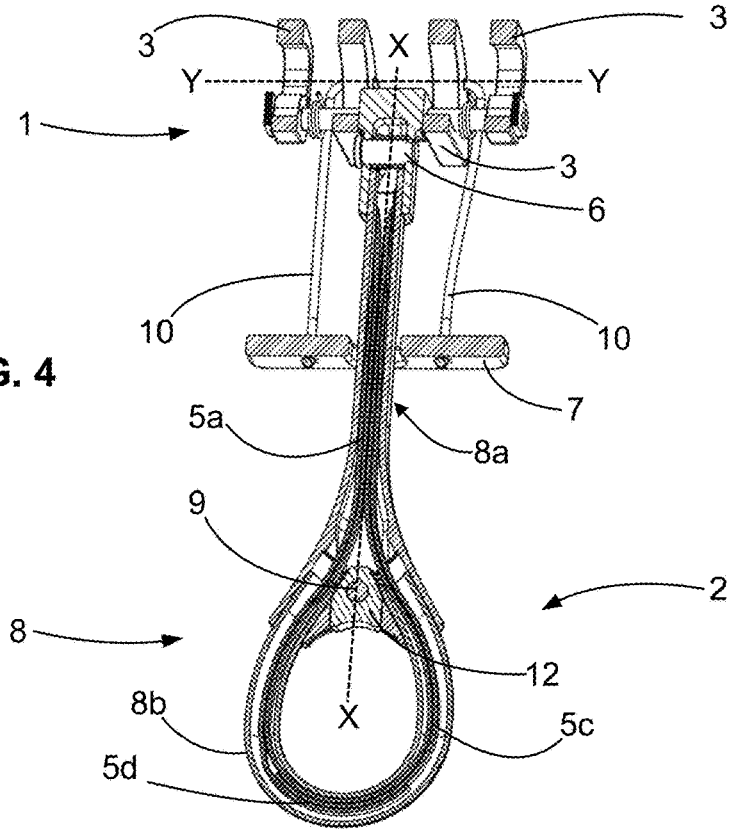
FIG. 4 schematically illustrates a sectional view of a first embodiment of a camming clamping device, in the stretched position.
Figure 5:
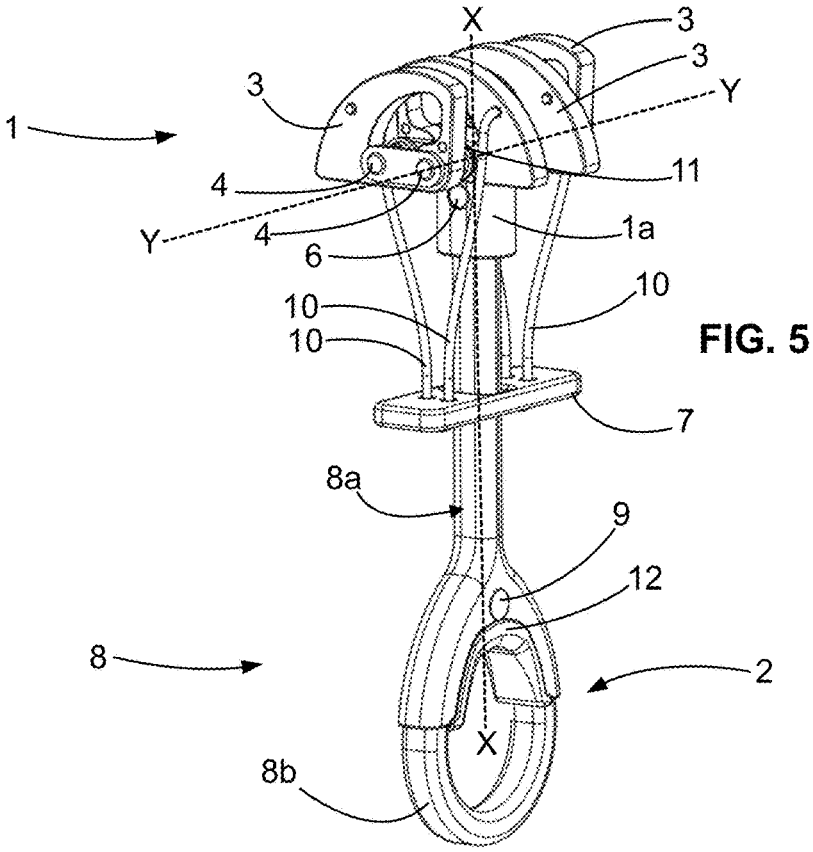
FIG. 5 schematically illustrates a perspective view of a second embodiment of a camming clamping device.
Figure 6:
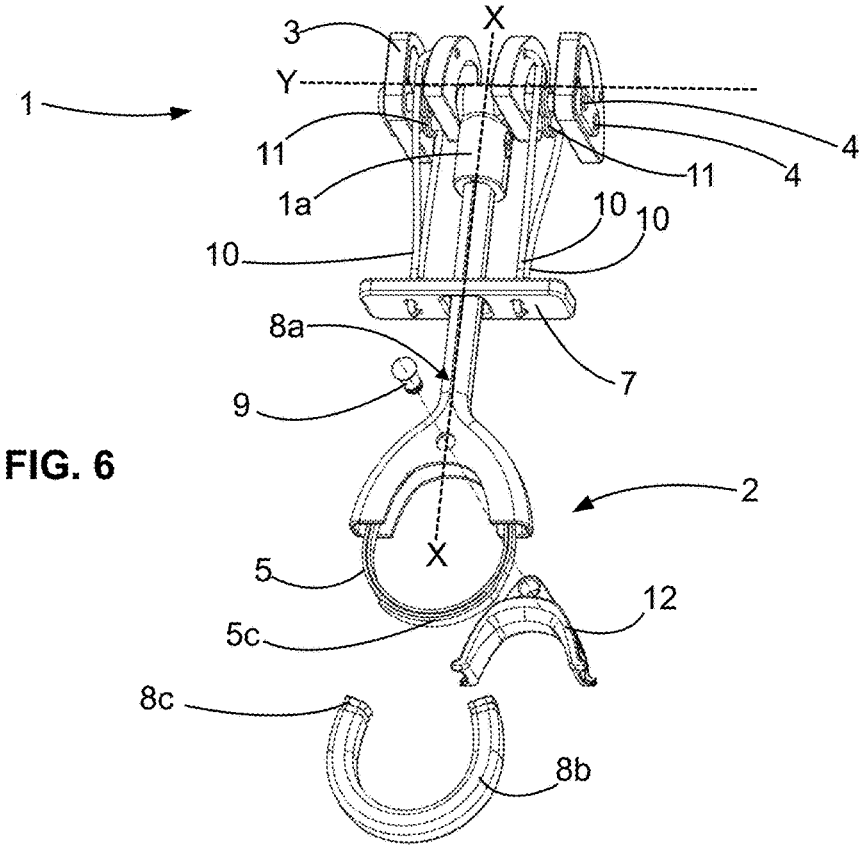
FIG. 6 schematically illustrates a perspective view of a second embodiment of a camming clamping device with an exploded view of the annular end.

In the first clamp position which is a blocking position, the clamp 12 reduces the available cross-section for sliding between the first part 8*a* and second part 8*b*. The position of the distal part 8*b* is fixed with respect to the proximal part 8*a*. In the second clamp position which is a sliding position, the clamp 12 moves away having the effect of increasing the available cross-section and of allowing the length of the rod 8 to be adjusted. FIGS. 3 and 4 show a clamp 12 one end of which is in the form of a wedge, the depth of depression of the clamp 12 in the rod 8 defining the degree of narrowing of the cavity designed to receive the end of the distal part 8*b*.

It is particularly advantageous to install the clamp 12 in the portion of the rod 8 that defines the annular end 2 rather than in the tubular part that connects the head to the annular end 2. This makes it possible to have more available space to avoid the formation of a favourable friction area with the wire element 5. This enables the tubular part of the distal part 8*b* to better adapt its shape according to the applied stresses. This also makes installation of the rod 8 easier to perform.

For example, in the first clamp position, the clamp 12 wedges at least one termination or both terminations of the distal part 8*b* against the proximal part 8*a* as illustrated in FIGS. 3, 4, 7, 8, 10 and 13. When the clamp 12 only wedges one termination of the distal part 8*b*, the other termination is up against the stop formed by the proximal part 8*a*.

In the embodiment illustrated in FIGS. 1 to 4, proximal part 8*a* defines two cavities designed to receive the two ends of the distal part 8*b*. In a first clamp position, the clamp 12 blocks the position of the distal part 8*b* with respect to the 25 proximal part 8*a*. In a second clamp position, the clamp 12 allows movement of the position of the distal part 8*b* with respect to the proximal part 8*a* in the first direction XX. Such an assembly facilitates installation of the tubular part in the cavities followed by application of a tensile force on the tubular part and on the wire element to stress the rest of the rod 8 in compression.

FIGS. 1 to 4 illustrate an embodiment where the clamp 12 is fixed in a hole of the proximal part and reduces the cross-section available for the distal part 8*b*. The terminations of the distal part 8*b* deform and are wedged against the proximal part 8*a* thereby fixing the position of the distal part 8*b* with respect to the proximal part 8*a*.

FIGS. 5 to 8 illustrate an embodiment where the clamp 12 defines at least one tooth or one crenellated part 8*c* and the distal part defines a crenellated part or at least one tooth. Once the clamp 12 has been fixed to the proximal part 8*a*, the crenellated part and the at least one tooth fix the position of the distal part 8*b*. The clamp 12 defines a wall of the cavity designed to receive the end of the distal part 8*b*.

Figure 9:
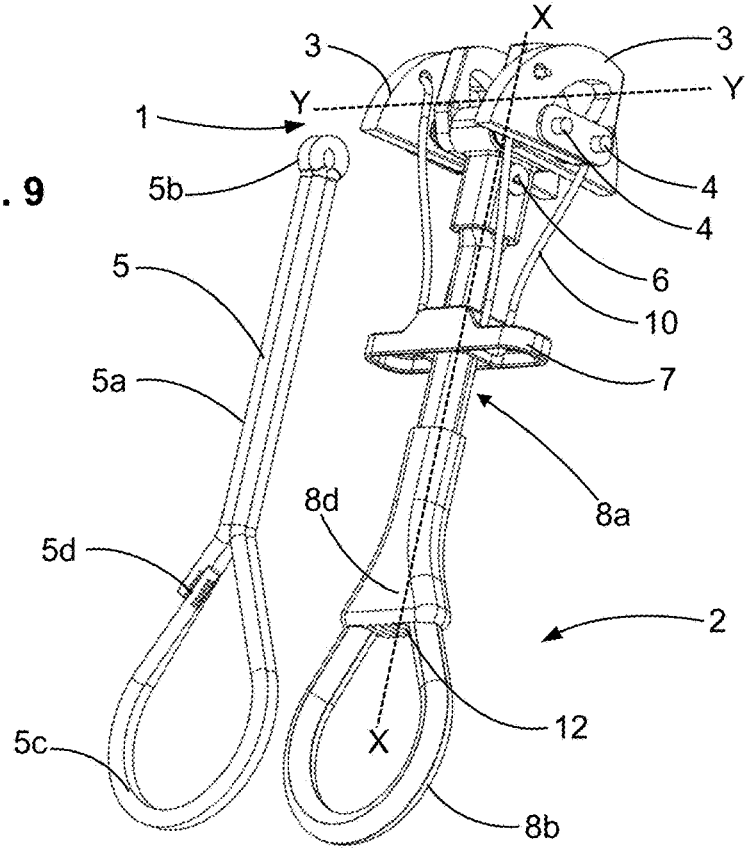
FIG. 9 schematically illustrates a perspective view of a third embodiment of a camming clamping device with representation of the equivalent conformation of the wire element.
Figure 10:
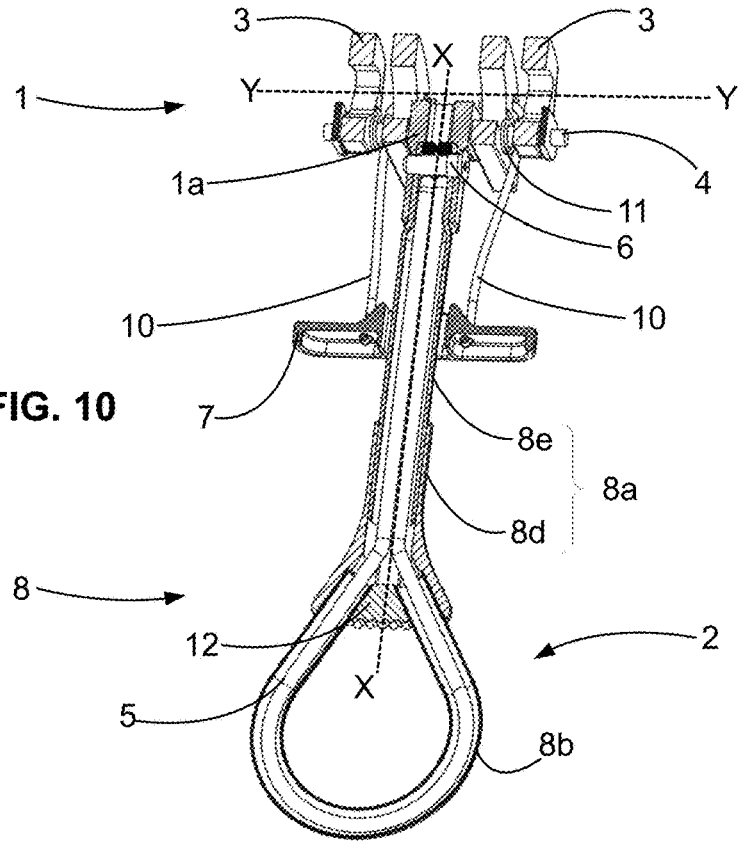
FIG. 10 schematically illustrates a sectional view of a third embodiment of a camming clamping device, in a non-stretched position.

FIGS. 9 to 11 illustrate another embodiment with a proximal part 8*a* that is a telescopic proximal part. The clamp 12 is fixed to proximal part 8*a* and wedges distal part 8*b* to fix the position of distal part 8*b*. Assembly of proximal part 8*a* in two parts makes installation of the rod 8 easier to perform. The proximal part 8*a* has a first portion 8*d* and a second portion 8*e* assembled movable with respect to the first portion 8*d* in the first direction XX. In the position illustrated in FIG. 9, the proximal part 8*a* is in an extended position. In the position illustrated in FIG. 10, the proximal part 8*a* is in a retracted position. The configuration of the proximal part 8*a* between the extended position and the retracted position is independent from the position of the at least one cam 3 and from the position of the trigger 7. The proximal part 8*a* can have its own clamp to fix the position of the second portion 8*e* with respect to the position of the first portion 8*d*. For example, the first portion 8*d* and the second portion 8*e* define a set of grooves and teeth that only allow the length of the rod 8 to be increased.

In preferential manner, once the proximal part 8*a* has been placed in the extended position, it is not possible to return to the retracted position or the force required to reach the retracted position is greater than the force applied between the wire element 5 and the rod 8 to stress the rod 8 in compression. The use of a proximal part 8*a* in at least two portions, preferably with a telescopic assembly, facilitates installation of the rod 8 and tensioning of the wire element 5. Preferably, in the retracted position, the proximal part 8*a* and the distal part 8*b* are incapable of stretching the wire element 5. The clamp 12 enables a more precise adjustment of the length of the rod 8 to be achieved.

Figure 13:
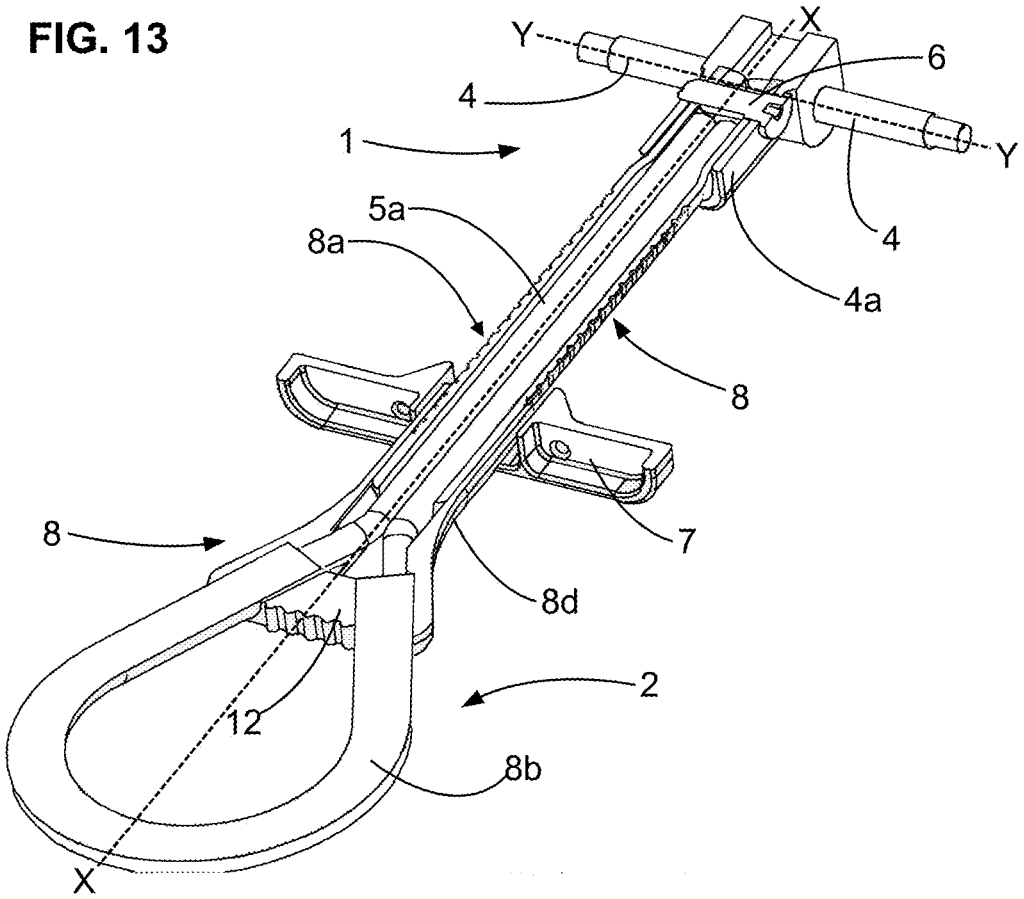
FIG. 13 schematically illustrates a sectional view of a fourth embodiment of a camming clamping device, in the stretched position.

In yet another embodiment a particular configuration of which is illustrated in FIGS. 12 and 13, distal part 8*b* and proximal part 8*a* are assembled movable with respect to one another to define several stable positions of the distal part 8*b* with respect to the proximal part 8*a*. In the particular configuration illustrated, distal part 8*b* and proximal part 8*a* define a groove and tab device that enables the length of the rod 8 to be defined.

The distal part 8*b* is preferentially engineered in two parts with a first portion 8*d* and a second portion 8*e*. The two portions are not configured to adjust the length of the rod 8 by a relative movement between the first portion 8*d* and the second portion 8*e*. The clamp 12 reduces the available cross-section for the second portion 8*e* to pass which has the effect of wedging the second portion 8*e* with respect to the first portion 8*d*. The wedging of the second portion 8*e* pulls on the wire element 5. When the clamp 12 is removed, the second portion 8*e* provides a sufficient space for wire element that can deform to reduce the tensile stress value. Installation of the clamp 12 is obtained after the wire element has been stretched to free the space designed to receive the clamp 12.

In the illustrated embodiments, the rod 8 is represented in the form of a telescopic rod 8. Other embodiments are however possible.

The use of a rod 8 of adjustable length is particularly advantageous to control the rigidity of the rod 8 perpendicularly to the first direction XX by applying a stress by means of the wire element 5. Such an embodiment facilitates manufacture in plant.

Such a configuration is particularly advantageous for manufacture of the camming clamping device. Such a configuration is particularly advantageous for replacement of the wire element of the camming clamping device and/or of the rod 8.

For manufacture of the camming clamping device, a camming clamping device according to any one of the above configurations is provided. The rod 8 is lengthened so as to increase the distance between the head 1 and the annular end 2 which has the effect of applying a tensile force on the wire element 5 and a compressive force on the rod 8. The length of the rod 8 is adjusted to the predefined length. The length of the rod 8 is blocked by means of the clamp 12.

Such a configuration is particularly advantageous when performing a repair operation of the camming clamping device. For example, if the rod 8 is damaged and has to be changed, a variation of length between the initial rod 8 and the new rod 8 is easily compensated by adjusting the length of the rod 8 to the length of the wire element.

This configuration is particularly advantageous when it is desired to replace the wire element 5 ensuring the mechanical continuity between the head and the annular end 2. The uncertainties on the size of the head, on the length of the wire element and on the length of the rod 8 result in a clamping device never or harldy ever being disassembled to proceed with replacement of the wire element 5.

Providing a rod 8 of variable length enables manufacturing uncertainties to be compensated and thus makes it possible to provide a new wire element 5, and preferably a replacement kit comprising a new wire element and a new rod 8.

A camming clamping device is provided comprising a head 1 connected to an annular end 2 by a wire element 5 and a rod 8. As indicated in the above, the head 1 is provided with at least one cam 3, at least one pivot shaft 4, at least one spring 11 and a trigger 7 mechanically connected to the at least one cam 3.

The rod 8 and the wire element 5 are removed. The new wire element 5 and rod 8 are attached together to the head 1, the wire element 5 passing through the rod 8. The rod 8 is lengthened so as to increase the distance between the head 1 and the annular end 2 which has the effect of applying a tensile force on the wire element 5 and a compressive force on the rod 8. The length of the rod 8 is set to the predefined length and the required length is fixed by means of the clamp 12. Care must be taken to replace the rod 8 in the corresponding hole of the trigger 7.

To facilitate fixing of the wire element to the head, it is advantageous for the rod 8 to be in the retracted position or in a position where it occupies a small amount of space. The length of the rod 8 is then increased to apply a compressive stress on the rod 8.

Replacement of the wire element can be performed with limited equipment which means that the replacement operation can easily be performed by dedicated operators or even by the user.

It is further possible to replace the rod 8 and the wire element 5 to adjust the length of the clamping device to a specific requirement. An extensor of the trigger 7 can then be envisaged if the length of the rod 8 and the length of the wire element 5 are considerably increased.

FIGS. 1 to 13 illustrate a rod 8 with a proximal part 8*a* that is inserted in the head 1, more preferentially in the body 1*a* of the head so that proximal part 8*a* comes up against the stop formed by one of the components of the head 1. This embodiment is advantageous as it enables the proximal part to be installed and removed easily. When the rod 8 is not under a compressive stress, the rod 8 can move in the first direction XX. As an alternative, the proximal part 8*a* can be fixed directly to the head 1.

In the illustrated embodiments, the camming clamping device presents four cams 3. It is possible to use more or less cams 3. The illustrated configurations for installation of the wire element 5 are applicable on clamping devices that comprise one, two, three, four or more cams 3. The number of cams 3 can be even or odd. The cams 3 are preferentially made from metallic material, for example from aluminium alloy or steel.

The rod 8 is preferentially made from polymer material so as to be able to be flexible in one or more directions perpendicular to the first direction XX.

The embodiments presented in the above are particularly advantageous for a wire element made from textile material the lifetime of which is shorter than its equivalent made from metal. Furthermore, the ring formed from the wire element 5 is manufactured in plant with well-mastered stitching methods enabling a good mechanical strength of the wire element 5 to be ensured.

In preferential manner, the wire element 5 is in the form of a ring and it is advantageous to shape the ring to form a "U". The figures illustrate a ring that is shaped, for example folded, into the shape of a U with two legs 5*a* each of which is terminated by a loop 5*b*. A connecting portion 5*c* also exists connecting the two legs 5*a*. The connecting portion 5*c* is preferentially a central portion. Preferentially, the seam 5*d* is located in the central portion to limit the space occupation in the head 1 or close to the head 1. The two legs 5*a* of the U-shaped wire element pass through the rod 8 to open into the head 1 facing the anchoring part 6 in a direction perpendicular to the direction XX, here the direction YY, but another configuration is possible.

In preferential manner, each of the legs 5*a* is terminated by a loop 5*b* that is passed through by an anchoring part shaft of the head 1.

Once it has been installed in the camming clamping device, the wire element 5 has a first loop 5*b* fixed to the head 1. The first leg 5*a* extends from the head 1 up to the annular end 2. The wire element 5 extends along the annular end 2 and returns to the head 1 via the second leg 5*a*. Application of a tensile force between the head 1 and the annular end 2 has the effect of tensioning the wire element 5. In the illustrated embodiment, there are four strands of the wire element that connect the head 1 to the annular end 2. More or less strands of wire elements are possible.

The connecting portion 5*c* extends along the annular end 2 whereas the two legs 5*a* each extend in the direction of the head 1.

FIGS. 1 to 13 illustrate embodiments in which the two loops 5*b* present at the two ends of the ring folded into a U-shape are passed through by an anchoring part shaft 6. For example, anchoring part shaft 6 is fixed to the body 1*a* of the head 1 by screw-fastening, by crimping, or by riveting. Depending on the embodiments, anchoring part shaft 6 is installed removable or non-removable from the rest of the head 1. The two ends of the wire element 5 are inserted in the head 1. Anchoring part shaft 6 passes through the two loops 5*b* and performs the two attachments of the wire element with the head 1. Anchoring part shaft 6 is fixed at its two ends with the body 1*a*.

It is particularly advantageous to have an anchoring part shaft 6 installed removable with respect to the head 1 so as to have a wire element 5 that is easily replaceable. Disassembly of anchoring part shaft 6 enables the attachment between the wire element 5 and the head 1 to be eliminated enabling the wire element 5 to be replaced.

It is advantageous to have a head 1 that defines a blind hole to prevent the wire element 5 from passing through the head in the first direction XX.

In an alternative embodiment, anchoring part shaft 6 may not be disassemblable. By preventing disassembly of anchoring part shaft 6, safety is enhanced preventing a cause of incorrect reassembly. The two legs 5*a* enter the body 1*a* and pass round anchoring part shaft 6. The two legs 5*a* exit from the head 1 in the direction of the annular end 2 and the annular end 2 passes through the loops 5*b* at the ends of the two legs 5*a*. By pulling on the wire element 5, a cow hitch is formed around anchoring part shaft 6 securing wire element 1 with the head 1. This embodiment may be complicated to implement if the space in the head 1 is limited to allow sliding of the wire element 5 and passing around anchoring part shaft 6.

The anchoring part 6 can be destructible with respect to the head. Destruction of the anchoring part 6 enables the mechanical connection between the wire element and the head to be eliminated. This enables a wire element to be replaced by another wire element.

To make replacement of the wire element 5 and/or of the rod 8 easier to perform, it is advantageous to install the anchoring part underneath the space occupied by the at least one pivot shaft 4 and occupied by the at least one cam 3. In other words, the anchoring part is not arranged facing a pivot shaft 4 and facing at least one cam 3 in a direction of observation that is parallel to the swivelling axis of the at least one pivot shaft 4.

The anchoring part is arranged between the at least one cam 3 and the annular end 2. Such an arrangement enables an easier access to be had to the anchoring part enabling the head 1 and the wire element to be separated from one another without having to disassemble one or more cams 3 or one or more pivot shafts 4.

The invention claimed is:

1. Camming clamping device comprising:

a head;

at least one pivot shaft fixed to the head;

at least one cam coupled to the head and installed movable swivelling around the at least one pivot shaft, the at least one cam being movable between a retracted position and an extended position;

a spring coupled to the at least one cam to bias the at least one cam to the extended position;

an annular end mechanically coupled to the head, the annular end being designed to receive a connecting part;

at least one wire element continuously connecting the head and the annular end, the at least one wire element extending in a first direction and passing through a rod;

the rod extending from the head to the annular end in the first direction, the rod having a first end fixed to the head and a second end totally or partially defining the annular end, wherein the rod is of adjustable length to apply a tractive force to the at least one wire element from the head to the annular end, the rod has at least a proximal part and a distal part, the distal part being arranged movable with respect to the proximal part to adjust the length of the rod;

an actuating system configured to selectively engage the retracted position of the at least one cam, the actuating system having a trigger installed slidingly along the first direction; and at least one clamp is configured to block the rod at a required length by blocking a position of the distal part with respect to the proximal part.

2. Camming clamping device according to claim 1 wherein the at least one clamp only blocks the distal part with respect to the proximal part without jamming the at least one wire element.

3. Camming clamping device according to claim 2 wherein the at least one wire element is a textile wire element.

4. Camming clamping device according to claim 3 wherein the textile wire element defines a stitched ring and the distal part comprises a tubular element, the at least one wire element passing through the tubular element, the at least one wire element being fixed to the head.

5. Camming clamping device according to claim 3 wherein the at least one wire element is attached to the head by an anchoring part, the anchoring part being arranged at a distance from the at least one cam and arranged at a distance from the at least one pivot shaft, the anchoring part being arranged between the annular end and the at least one pivot shaft.

6. Camming clamping device according to claim 2 wherein the proximal part extends from the head up to a portion of the annular end, the at least one clamp partially defining a through hole in the annular end.

7. Camming clamping device according to claim 6 wherein the proximal part partially defines the through hole of the annular end.

8. Camming clamping device according to claim 1 wherein the rod is a telescopic rod.

9. Method for adjusting at least one wire element of a camming clamping device comprising the following steps:

providing a camming clamping device according to claim 1;

lengthening the rod to apply a tractive force and stretch the at least one wire element and apply a compressive stress on the rod;

fixing the length of the rod stretching the at least one wire element.

* * * * *